US006255957B1

(12) United States Patent
Sonderegger et al.

(10) Patent No.: US 6,255,957 B1
(45) Date of Patent: Jul. 3, 2001

(54) PROCESS AND DEVICE FOR CONTROLLING THE CLOSURE OF LOCKS

(75) Inventors: Wilhelm Sonderegger, Dornbirn; Thomas Hupp, Feldkirch; Georg Kuehne, Rankweil, all of (AT)

(73) Assignee: VOS Verkehrs-Optimierungs-Systeme GmbH & Co. KG, Dornbirn (AT)

( * ) Notice: Subject to any disclaimer, the term of this patent is extended or adjusted under 35 U.S.C. 154(b) by 0 days.

(21) Appl. No.: 09/341,089

(22) PCT Filed: Dec. 30, 1997

(86) PCT No.: PCT/EP97/07313

§ 371 Date: Aug. 16, 1999

§ 102(e) Date: Aug. 16, 1999

(87) PCT Pub. No.: WO98/29626

PCT Pub. Date: Jul. 9, 1998

(30) Foreign Application Priority Data

Dec. 31, 1996 (DE) ..... 196 54 443

(51) Int. Cl.[7] ..... G08B 21/00

(52) U.S. Cl. ..... 340/686.1; 340/542; 340/5.32; 340/5.33; 70/278.2; 70/278.4; 70/432; 70/433

(58) Field of Search ..... 340/686.1, 542, 340/545.2, 687, 686.2, 691.1, 825.31, 5.1, 5.2, 5.3, 5.32, 5.33; 70/57.1, 91, 156, 179, 263, 278.2, 278.3, 278.4, 432, 433, 460

(56) References Cited

U.S. PATENT DOCUMENTS

| | | | | |
|---|---|---|---|---|
| 3,792,493 | | 2/1974 | Hughes | 346/20 |
| 4,432,218 | * | 2/1984 | Hoener | 70/395 |
| 4,440,011 | * | 4/1984 | Klein | 70/438 |
| 4,631,943 | * | 12/1986 | Hoener | 70/395 |
| 4,908,605 | * | 3/1990 | Takatsuka | 340/542 |
| 4,936,896 | * | 6/1990 | Takatsuka | 70/432 |
| 5,025,426 | * | 6/1991 | Blumberg et al. | 368/10 |
| 5,111,007 | * | 5/1992 | Miller et al. | 200/43.08 |
| 5,337,588 | * | 8/1994 | Chhatwal | 70/278 |
| 5,435,160 | * | 7/1995 | Linsalato et al. | 70/408 |
| 5,548,984 | * | 8/1996 | Miyatsu | 70/276 |
| 5,552,777 | * | 9/1996 | Gokcebay et al. | 340/825.31 |
| 5,595,080 | * | 1/1997 | Whinton | 70/432 |
| 5,870,917 | * | 2/1999 | Mahot et al. | 70/408 |
| 6,000,609 | * | 12/1999 | Gokcebay et al. | 235/382 |

FOREIGN PATENT DOCUMENTS

| | | |
|---|---|---|
| 43 15 892 A1 | 11/1994 | (DE) . |
| 02136481 | 5/1990 | (EP) . |
| 04020681 | 1/1992 | (EP) . |
| 2 599 415 A1 | 12/1987 | (FR) . |

* cited by examiner

*Primary Examiner*—Daniel J. Wu
*Assistant Examiner*—Toan Pham
(74) *Attorney, Agent, or Firm*—Knobbe, Martens, Olson & Bear, LLP

(57) ABSTRACT

A process reliably detects the change of the locking state of at least one lock with a logic with memory and display attached to a key. The process includes determining a rotation of the key associated with the lock within the lock, detecting a single or multiple rotation in unlocking or locking direction of the lock and simultaneously determining whether the detected rotation occurs in unlocking or locking direction of the lock. A signal is generated that indicates the unlocking or locking of the lock. This signal is stored in the memory of the logic, and the signal is displayed. A device for implementing the process includes one or several markers mounted near the lock, one or several sensors non-rotatably connected with the key for detecting these markers, a logic attachable to the key with a memory in which data can be stored whereby the logic can process the signals received from the sensors, and a display for displaying the locking state.

50 Claims, 3 Drawing Sheets

PROCESS AND DEVICE FOR CONTROLLING THE CLOSURE OF LOCKS

Figure 1:
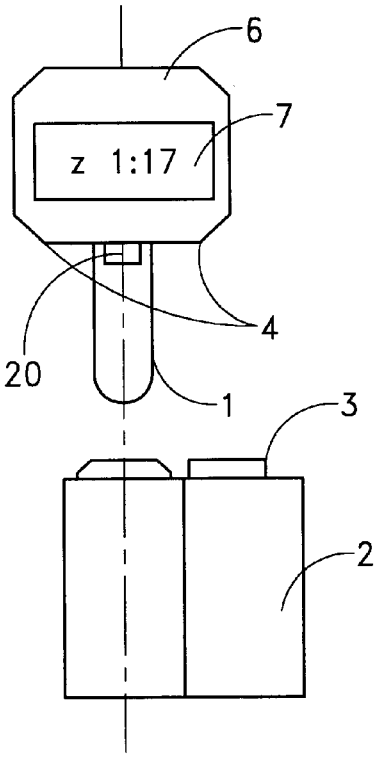

This is the U.S. national phase under 35 U.S.C. §371 of International Application PCT/EP97/07313, filed Dec. 30, 1997 which claims priority of DE 19654443.2, filed Dec. 31, 1996.

The present invention relates to processes and devices for detecting and displaying to a user the changes in the locking state of a lock or the absolute locking state.

Today, a single user frequently carries a number of keys for locking different locks. A single key often locks not only one but several locks. In day-to-day practice, this often means that the user forgets even shortly after the locking operation whether he actually locked the lock in question. In many areas he then has to check, irrespective of the distance involved, whether the lock has indeed been locked. This can cause significant trouble and involve a considerable amount of time.

Prior art essentially describes three different systems for solving this problem.

One principle, which works independently of the lock, is described in U.S. Pat. Nos. 4,440,011 and 5,435,160. The basic idea behind these two U.S. patents is to attach a rotatable key cap to the head of the key. This key cap is rotated when a lock is opened/closed and subsequently shows the rotational direction through a displaceable pin or similar device.

This principle has a number of disadvantages. The first and most serious is that such a mechanical indicator cannot distinguish between unlocking a door from the inside and locking it from the outside. Thus, if the key cap indicates, for example, a locked state, this can mean that the user of the key has unlocked a door. This system furthermore can be used only for the most recent locking of a lock. An additional drawback occurring in practice is the susceptibility of this system to the key being turned in opposite direction after unlocking or locking. It is relatively frequent that the key is turned beyond the position in which it can be pulled out of the lock. For the key to be withdrawn, it has to be rotated back in the opposite direction, which automatically causes the mechanical display to reset.

Prior art also knows a lock-dependent system described, for example, in JP 07054524 and JP 04038382. This system provides that when a certain position of the key is reached in relation to the lock, magnets mounted on the lock displace a magnet attached to the head of the key. There is a first position for locking the lock and a second position for locking [sic].

This system has the aforementioned drawbacks cited under lock-independent systems.

DE 43 27 294 shows a key equipped with a device for sensing a rotational movement. This system distinguishes between rotation to the left and to the right. A ball-type rotary transducer, a sliding tab, or a wheel turning within the lock during the rotation of the key is provided. The device does not detect whether the lock is being unlocked or locked. The system is preprogrammed as to whether the analyzing unit interprets a rotation toward the right as unlocking or locking so that each rotation to the right is displayed, for example, as unlocking. An actual verification whether unlocking took place is not provided and is not possible.

This document recognizes the problem that unlocking a door from one side requires the same direction of rotation as locking it from the other. To solve this problem, it is proposed to passivate one side of the door and thus of the lock so that the rotational movement of the key is either not detected or is ignored. This solution is unsatisfactory. Only one single lock can be taken into account and only from one side, e.g., from the outside. If the key used for this lock can also be used to lock other locks, these other locks must all be passivated on both sides. In other words, the lock that is to be sensed has to be passivated on one side and all other locks on both sides. As soon as passivation of only one side of a lock becomes ineffective, the system fails.

U.S. Pat. No. 4,908,605 deals with a key used in conjunction with a special, fixed analyzing unit. The key is provided with magnet switches that are actuated as the key is turned within the lock to indicate right or leftward rotation. Whether the lock is being unlocked or locked is not detected in the key but in an additional device into which the key is inserted. The magnet switches used are unreliable in practice since shocks may cause them to switch. The state of only a single lock can be detected.

DE 43 15 892 deals with a networked system including a master control station. Here, cables connect several locks to a master control station, which is fixed in relation to the locks. Each lock transmits its locking state to the master control station from where each individual lock can be polled. If required, transmission is possible from the master control station to a user located nearby. Specific sensing of a single lock is not possible; the master control station transmits only information regarding all locks being sensed. For example, if only one of these locks remains unlocked, the information "Open" is transmitted. An association of this information with the open lock is not possible.

The information is furthermore to be transmitted from the master control station to the key only if the key has been recognized as authorized. Thus, the data exchange preferably takes place in two directions. In addition, the signal sent by the master control station is encoded.

This system has a number of further disadvantages. First of all, it is a very costly and complex system that moreover cannot be upgraded. Furthermore, the user cannot directly check the locking state, but has to wait until the master control station transmits the information. This requires physical contact between key and lock. Moreover, such a system fails completely as soon as the distances between the individual locks to be locked are relatively great, e.g., from the house or apartment door to the office.

The object of the present invention is to provide processes and devices of the initially described type, which are simple, safe, reliable, and practically error-free in operation, are usable for a wide variety of keys/locks, and can be upgraded at little cost.

According to the invention, this objective is attained by the technical teaching of the independent claims.

The invention essentially proposes two different methods for attaining this objective. The first method, described in Claims 1, 2 and 17 as well as in the associated subclaims, essentially detects the rotation of a key inserted in the lock. Simultaneously to the rotation, a signal is generated. This signal either directly indicates the unlocking or locking of the lock (Claim 1) or it is a coded signal associated with the locking direction, which must first be decoded by data matching (Claim 2). As a function of this signal, data as to whether the lock has been unlocked or locked is subsequently stored and a corresponding display is activated.

The present invention is not necessarily intended to detect a rotation to the left or right. A first embodiment determines whether the key is rotating. At the same time it determines whether the lock is being unlocked or locked, independent of the actual direction of rotation. Thus, the direction of rotation is not determined first with a subsequent check whether this direction of rotation causes unlocking or locking. Rather, locking or unlocking is determined directly during the rotation.

The process according to Claim 2 can provide that the determination of the rotation including detection of the direction of rotation and the association with the locking direction are executed separately from each other. Thus, the system detects whether the key is being turned to the left or right and at the same time detects whether the lock locks toward the left or right. This detection is advantageously effected by markers mounted near the lock. The signal can thus include either only the direction of rotation (toward the left or right) or the direction of rotation and the locking direction.

This process can be further developed in that only sensors attached to the key itself, e.g., position sensors or ball sensors, detect the rotation of the key. Thus the key itself determines its own direction of rotation.

The rotational movement of the key is thus not only detected in terms of left or right, but also in terms of the direction, or in conjunction with the direction, of unlocking or locking. This reliably solves the problem of the inside or outside of the door.

The detection of the rotational movement can furthermore be designed such that a slight rotation of the key in the opposite direction is either not recognized at all or it is recognized but identified as such. This prevents an indication error in the case of such a slight rotation in opposite direction, which happens frequently in practice.

In addition, this process and the associated device can be readily used for multiply locking locks; any double or triple rotation during unlocking or locking of the lock is recognized as such.

The system is furthermore capable not only of displaying and storing the state of a single lock, but can also be used for several locks that are locked with the same key. For this purpose, the system not only detects locking or unlocking during the rotation of the key, but at the same time identifies the lock. This lock identification can be detected either together with said signal or as a separate signal.

A further advantage is that the process according to the invention can be used for all known lock types. For example, there are patent keys that can be inserted into the lock in two positions—typically rotated by 180°. Such rotated insertion can be taken into account in advance by the design so that it does not result in indication errors.

To increase the reliability of the system, an additional step may be provided to detect the insertion of the key into and/or the inserted state of the key within the lock. This prevents the system from detecting an unlocking or locking motion when the key is loosely carried in a pocket.

In practice, however, the verification as to whether a key is being inserted or is in its inserted state is preferably carried out via a mechanical switch for cost reasons. To make the system easy to use, however, all detection, determination and identification steps are preferably contactless.

In addition, the change in the locking state of a lock may be coupled with a relative time display—starting of a timer to inform the user how much time has elapsed since unlocking/locking—or with absolute time—e.g., unlocking/locking at 10:15 am.

In one embodiment, the display can be switched or disabled by pressing corresponding buttons, switches or keys. The display may also be left on continuously and switched between different locks at periodic intervals, e.g., intervals of a few seconds.

The practical implementation (cf. Claim 17 and the associated subclaims) includes one or several markers mounted near the lock. One or several sensors that can detect these markers are attached to the key itself or to a part that can be attached to the key, e.g., a key cap. As the key is rotated, the sensor(s) sweep across the markers, whereby the marker detection sequence is a function of the key's direction of rotation. The sensors generate a corresponding signal, which can be stored in a memory that can be attached to the key and, where indicated, processed by a logic that can also be attached to the key. Subsequently, the new state of the lock is displayed.

Different parts of the device do not necessarily have to be attached to the key itself, but can be accommodated, for example, in a key attachment.

Unlocking or locking of several locks can be reliably determined by appropriate coding, i.e. a specific marker sequence. These markers are mounted, for example, clockwise on the inside of the door and counterclockwise on the outside. Thus, unlocking or locking is reliably detected on both sides of the door.

Furthermore, the lock can be identified by polling the markers.

In practice, it is preferred if the markers are made as magnets, which are swept by Hall sensors and/or reed sensors to detect the magnetic field. The magnets can be mounted in such a way that their north or south pole points to the key. Alternatively, the magnets may be mounted lengthwise and are then swept by the corresponding sensors in lengthwise direction.

It is of course also possible to use optical sensors operating, for example, with different colors or bar codes.

The display itself can be implemented in any manner, but a liquid crystal display (LCD) is preferred. In addition, an optical or acoustic signal generator may be provided to alert the user to any change in the locking state and/or the correct/incorrect detection of such a change.

In practice, this system is subject to only one type of indication error. This indication error occurs if a multiply locked lock is opened only once, i.e., is rotated from locking stage 2 to locking stage 1. In this case, the lock is still locked, but the display indicates an open lock.

This indication error is not critical, however. First, a lock will rarely be incompletely opened since a user who is unlocking a lock typically intends to open the door. In the aforementioned case, the lock will therefore be completely opened as a rule, so that the display will coincide with the locking state.

Secondly, the system is extremely reliable even in this case. To be avoided is a lock which is shown to be locked when it is actually open. In the described case, a closed lock is erroneously shown to be open. Thus, a user can assume in any case that if the display shows the lock to be locked, it is indeed locked.

The invention proposes an additional method for detecting the locking state of a lock and transmitting it to the user. This embodiment is the subject of independent claims 8 and 22 and their subclaims.

The associated process consists of continuously determining the locking state of the lock. A corresponding signal is then transmitted to a logic that can be attached to the key. This transmission can be continuous. However, to save energy, it is preferred if transmission takes place periodically or only under certain circumstances. It is preferred if transmission occurs only after a change in the locking state. The locking state is stored and possibly displayed.

In this embodiment the locking state is detected and transmitted to a logic that can be attached to the key. Each lock included can be individually and separately polled and coded. There is no identification of the key with respect to the lock. There is no master station location involved, which is fixed in relation to the locks and provides information only for a group of locks as a whole.

To make the entire system easy to use, contactless or wireless transmission of the corresponding signals is provided in this case as well.

The signal is not intended to be transmitted over significant distances, but only if a key is located near the closed lock. It can be assumed that this is the case after the locking state has been changed.

Of course, the lock in this embodiment can again be identified by means of a suitable signal. Association with the absolute time or starting of a timer is also possible.

Thus, the system according to the invention can be used to lock several locks successively. The signal serving to identify the lock makes it possible to associate the locking state with each lock and to identify or display the locking state of each lock.

The associated device comprises a lock sensor module mounted near the lock to detect the locking state of the lock. This signal is transmitted via a transmitter to a memory with the receiver attached to the key, where it is subsequently displayed.

The lock sensor module can either be integrated in the lock mounted on the door or arranged on the doorframe in the area of the striking plate. The second variant has the advantage that it does not recognize any locking of the lock when the door is open and is thus more reliable.

As in the first embodiment, the corresponding components associated with the key can be arranged not only on the key itself but also, for example, on a key attachment. Here, too, several buttons or switches may be provided for activating/deactivating the display, for switching and/or for resetting.

This additional embodiment of the invention permits fault-free detection of the locking state of a lock. This locking state is then transmitted to the receiver attached to the bunch of keys, which requires only a very short distance to be traversed. Transmitting power can therefore be low to save energy. It is also possible, however, to overcome greater distances by providing suitable transmitters.

In a further development of this additional embodiment according to the invention, the lock sensor module near the lock can also be linked to a timer or absolute clock, which is started when the locking state is changed. A time comparison upon the second locking operation then makes it possible to determine whether the lock has been locked by a third party in the meantime.

In contrast to the prior art methods where the locking state is detected within the lock (DE 43 15 892), it is also possible to include very remote locks in a single display.

Furthermore, the system does not require any complex wiring or the use of powerful transmitters.

The subject of the present invention results not only from the subject of the individual claims but also from the mutual combination of individual claims.

All information and features disclosed in the documents, including the abstract, particularly also the spatial design depicted in the drawings, are therefore claimed as essential to the invention to the extent that they are novel compared to the prior art either in themselves or in combination.

Below, the invention is further explained by means of several embodiments depicted in the drawings. The drawings and their description show additional inventive features and advantages that are essential to the invention.

Figure 2:
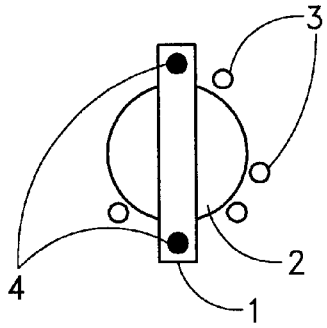
Figure 3:
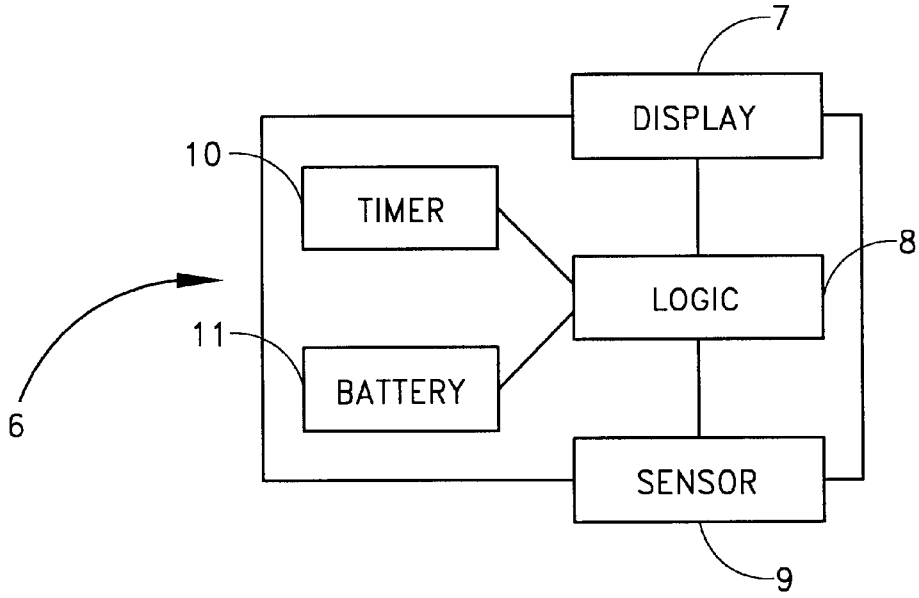
Figure 4:
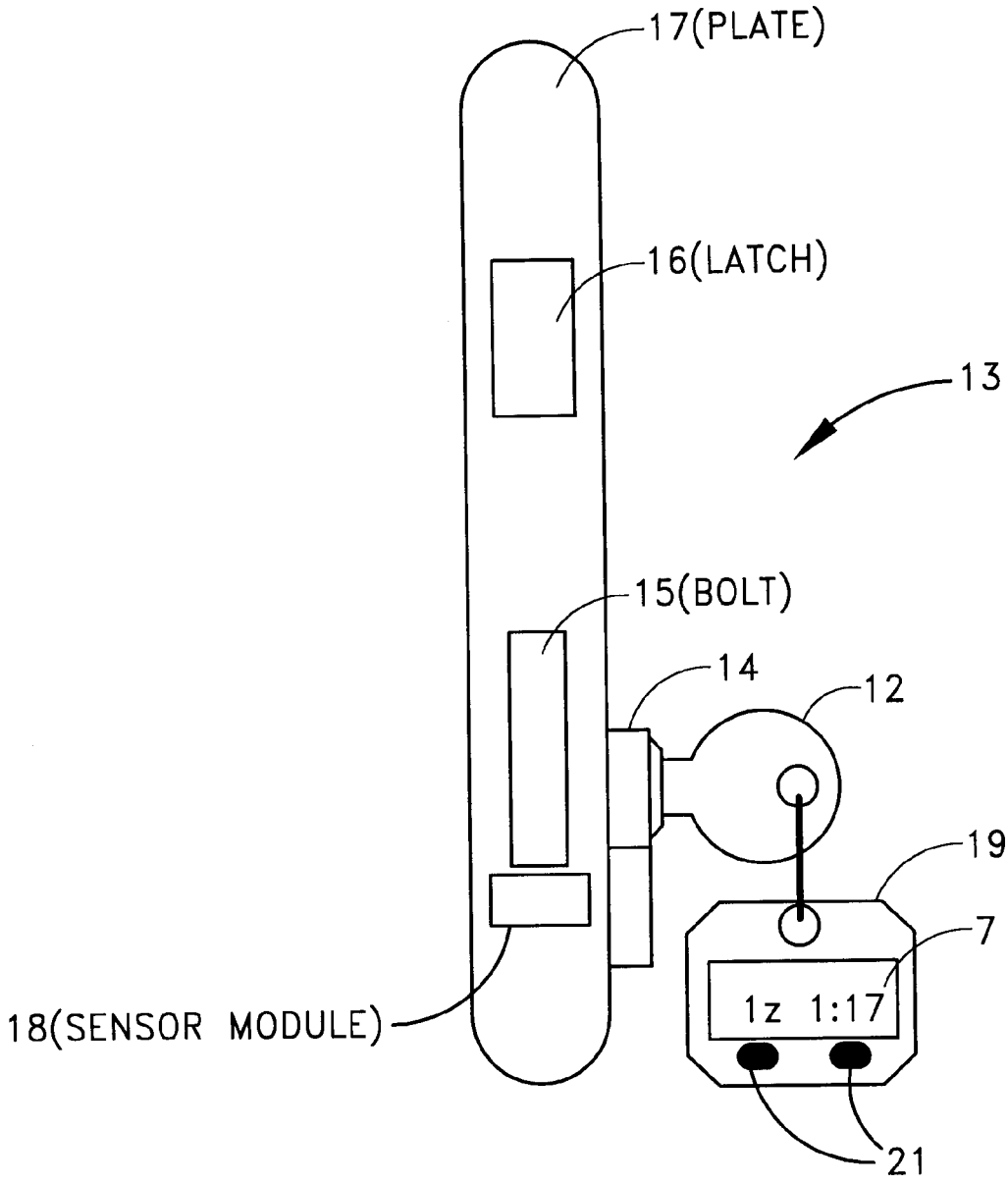
Figure 5:
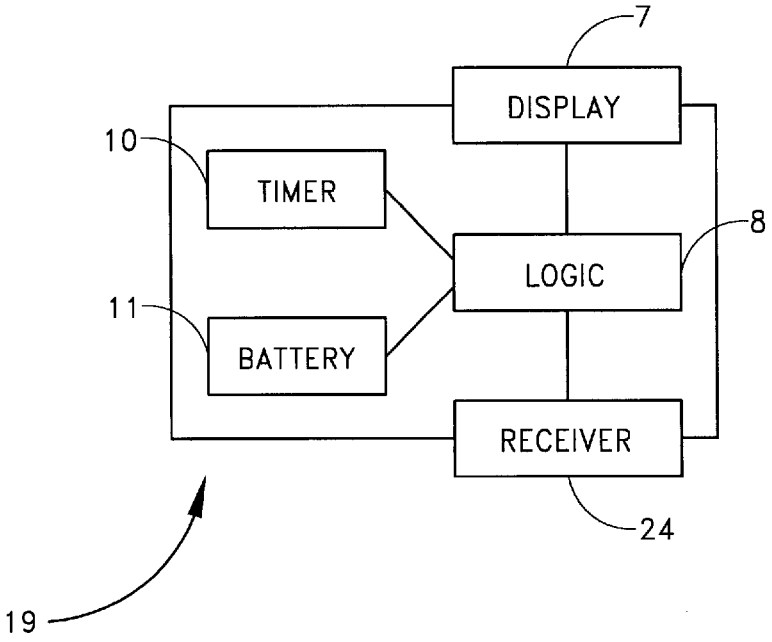
Figure 6:
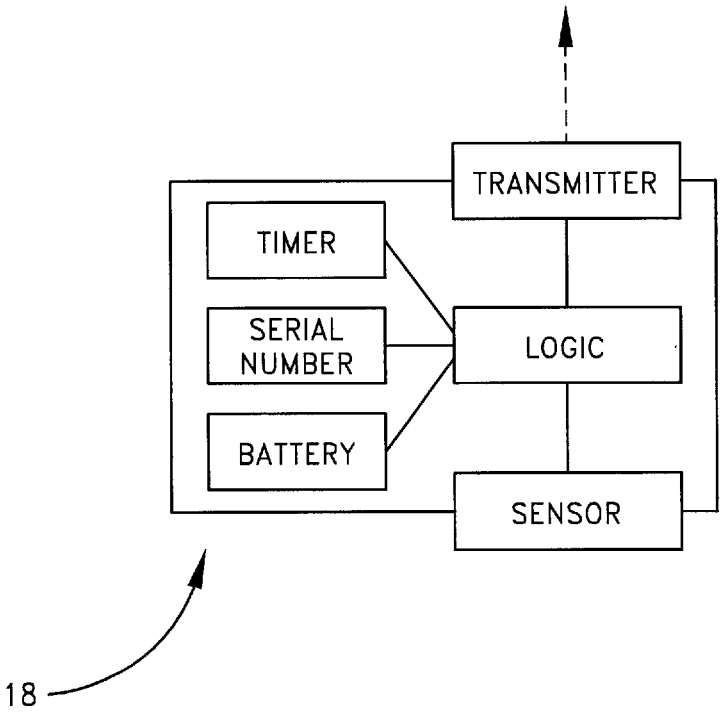

The following show:

FIG. 1: a schematic representation of an inventive key with the associated lock in a first embodiment;

FIG. 2: a view of the key inserted into the lock;

FIG. 3: a schematic circuit diagram of the associated electronic components;

FIG. 4: a schematic view of a second embodiment;

FIG. 5: a view of the electronic components associated with the key;

FIG. 6: a view of the electronic components associated with the lock.

FIGS. 1–3 schematically show a first embodiment of the present invention with associated circuitry.

A key 1 is provided, which can be inserted into a lock 2. In the embodiment shown, several markers, preferably magnets 3, are disposed around the lock 2, which can be detected by sensors 4 on the key 1.

If the key 1 is rotated in the direction of arrow 5, sensors 4 sweep across markers 3 in a predefined sequence. This sequence makes it possible to detect whether lock 2 is being unlocked or locked as well as to determine the identity of lock 2.

Sensors 4 can be accommodated, for example, in a key cap 6, which is simply pushed over the existing key.

Key cap 6 is provided with a display 7, which in FIG. 1 shows "z" for "Closed" as well as a time of 1 hour 17 minutes since the last locking operation.

The underlying circuitry essentially comprises logic 8 with a memory and a sensor mechanism 9 with sensors 4. The structure of the sensor mechanism 9 depends on the sensors used. If Hall sensors are used, the signal will be typically further processed in the sensor mechanism. For reed sensors, the signal can be supplied directly to logic 8. The signals generated in logic 8 are made visible on display 7. Also present are a timer 10 and a suitable energy storage mechanism 11, for example in the form of a battery.

In the embodiment shown, key 1 is furthermore provided with a plug-in sensor 20. This sensor 20 is activated as key 1 is inserted into lock 2, preferably by physical contact. As long as sensor 20 is not actuated, i.e., signals the insertion of key 1 into lock 2, sensors 4 are switched off or their signals are not being processed. This prevents any indication error.

It is of course also possible to provide various buttons, switches or keys as well as a loudspeaker or a lighting device of the display.

FIGS. 4–6 show a second embodiment in which a key 12 is already inserted into a lock 13. The lock shown is a typical lock with a cylinder 14, a bolt 15, a latch 16, and a striking plate 17.

The position of the bolt 15 is detected via a lock sensor module 18 with an associated transmitter 23 and is transmitted to a receiver 24, which in the embodiment shown is located on a key attachment 19. The corresponding signal is then displayed on display 7.

In this example, display 7 shows that a lock No. 1 was locked 1 hour and 17 minutes ago. Buttons 21, for example, may be used to switch between several locks.

The associated circuitry in key attachment 19 or in key 12 shown in FIG. 5 operates analogously to FIG. 3, but instead of the sensor mechanism for detecting signals, a receiver 24 is provided for receiving signals. These signals are transmitted by a transmitter 23, which is mounted near lock 13.

The associated circuitry of the lock sensor module 18 shown in FIG. 6 comprises a sensor mechanism 9, which detects the locking state, possibly via its own sensors (not depicted) and transmits it to its logic 8 with associated memory. Transmitter 23 is connected with logic 8. A timer 10 and suitable energy storage device 11 are again provided. The lock is identified, for example, in that a serial number 22 is imprinted on logic 8.

The collected signals are suitably processed and transmitted via transmitter 23 to receiver 24. As explained in the general part of the specification, transmission may be restricted to when the locking state of the lock has changed in order to conserve energy.

Overall, the subject of the invention provides many and extensive advantages compared to the prior art. Thus, it is possible to check from any distance if and when a lock has been locked. Furthermore, it is possible to associate the key last used. This information is linked to a key or a bunch of keys and thus is not accessible to third parties (data protection).

The key user can be informed directly or indirectly via suitable indication means (optical, acoustic or other). The entire system is usable even for locks that permit more than one rotation for locking. It can be used for the inside or outside of the door and it is easily upgraded.

The key can moreover be used for locks that are not recognized.

LIST OF REFERENCE NUMBERS

| | |
|---|---|
| 1. | key |
| 2. | lock |
| 3. | marker |
| 4. | sensor |
| 5. | arrow direction |
| 6. | key cap |
| 7. | display |
| 8. | logic/memory |
| 9. | sensor mechanism |
| 10. | timer |
| 11. | energy storing device |
| 12. | key |
| 13. | lock |
| 14. | cylinder |
| 15. | bolt |
| 16. | latch |
| 17. | striking plate |
| 18. | lock sensor module |
| 19. | attachment |
| 20. | plug-in sensor |
| 21. | button |
| 22. | serial number |
| 23. | transmitter |
| 24. | receiver |

What is claimed is:

1. A process for detecting the change of the locking state of at least one lock with a logic a memory and a display attached to a key comprising the following steps:

determining a rotation of said key associated with said lock within said lock and simultaneously determining whether said detected rotation is in an unlocking or locking direction of the lock;

determining the identity of said lock from among a plurality of locks that are actuated with said key;

generating a signal that indicates the unlocking or locking of said lock;

storing said signal in said memory of said logic; and displaying said signal.

2. The process according to claim 1, wherein the identification of the lock is stored and/or displayed.

3. The process according to claim 1, wherein detection of the insertion of the key into the lock and/or detection of the inserted state of the key within the lock is provided as an additional step.

4. The process according to claim 1, wherein the detection respectively the determination or identification is contactless.

5. The device for reliably detecting the change in the locking state of a lock according to claim 1, comprising:

one or several markers mounted near the lock, one or several sensors non-rotatable connected with the key for detecting these markers, a logic attachable to the key with a memory in which data can be stored, whereby the logic can process the signals received from the sensors, and a display for displaying the locking state.

6. The device according to claim 5, wherein one or several sensors (4) for detecting the rotation of the key (1) are provided on the key (1) or on an add-on part (6).

7. The device according to claim 5, wherein the markers are made as magnets.

8. The device according to claim 5, wherein the sensors are made as Hall sensors and/or reed switches.

9. The device according to claim 5, wherein an additional sensor is provided for detecting the insertion of the key into the lock and/or for detecting the inserted state of the key within the lock.

10. The device according to claim 5, wherein the logic with the memory, the display and possibly the receiver are accommodated in a part attachable to the key.

11. The device according to one of claim 5, wherein the display can be switched on or off manually.

12. The device according to claim 5, wherein one or several buttons are provided for activation/deactivation, switching, between different display modes an/or resetting.

13. The device according to claim 5, wherein the display is operating continuously and, if applicable, switches automatically at periodic intervals between locking states stored for several locks.

14. The process according to claim 1, wherein the change in the locking state of several locks is successively detected as well as stored and/or displayed.

15. The process according to claim 14, wherein the display is periodically switched between the individual, stored locking states of different locks.

16. The process according to claim 1, wherein after detection of the change in the locking state, a timer on the key is started.

17. The process according to claim 16, wherein the timer and/or the absolute time is displayed.

18. The process according to claim 1, wherein the detection of the change in the locking state is linked to the absolute time.

19. A process for detecting the change of a locking state of at least one lock having a logic with a memory and display attached to a key comprising the following steps:

determining a rotation and detecting the direction of said rotation of said key associated with said lock within said lock and simultaneously determining the locking direction of said lock;

determining the identity of said lock from among a plurality of locks that are actuated with said key;

comparing said detected direction of said rotation with said determined locking direction;

determining whether said lock is being unlocked or locked;

generating a corresponding signal;

storing said corresponding signal in said memory of said logic; and displaying said signal.

20. The process according to claim 19, wherein detection of the rotating motion of the key (1) is executed independently from the lock (2).

21. The process according to claim 19, wherein the identification of the lock is stored and/or displayed.

22. The process according to claim 19, wherein detection of the insertion of the key into the lock and/or detection of the inserted state of the key within the lock is provided as an additional step.

23. The process according to claim 19, wherein the detection respectively the determination or identification is contactless.

24. The process according to claim 19, wherein the change in the locking state of several locks is successively detected as well as stored and/or displayed.

25. The process according to claim 24, wherein the display is periodically switched between the individual, stored locking states of different locks.

26. The process according to claim 19, wherein after detection of the change in the locking state, a timer on the key is started.

27. The process according to claim 26, wherein the timer and/or the absolute time is displayed.

28. The process according to claim 19, wherein the detection of the change in the locking state is linked to the absolute time.

29. The device for reliably detecting the change in the locking state of a lock according to claim 19, comprising:

one or several markers mounted near the lock, one or several sensors non-rotatable connected with the key for detecting these markers, a logic attachable to the key with a memory in which data can be stored, whereby the logic can process the signals received from the sensors, and a display for displaying the locking state.

30. The device according to claim 29, wherein one or several sensors for detecting the rotation of the key are provided on the key or on an add-on part.

31. The device according to claim 29, wherein the markers are made as magnets.

32. The device according to claim 29, wherein the sensors are made as Hall sensors and/or reed switches.

33. The device according to claim 29, wherein an additional sensor is provided for detecting the insertion of the key into the lock and/or for detecting the inserted state of the key within the lock.

34. A process for the detection of the locking state of at least one lock and transmission of said locking state to the user involving the following steps:

continuous detection of said locking state of said lock with a lock sensor module;

transmission of a corresponding locking state signal to a logic with a memory and a display attachable to a key, wherein this transmission is triggered by a change in the locking state; determining the identity of said lock from among a plurality of locks that are actuated with said key;

storage of said locking state signal in said memory; and display of said locking state signal on said display.

35. The process according to claim 34, wherein an additional signal serving for lock identification is transmitted to permit individual detection of the locking state of several locks (13).

36. The process according to claim 34, wherein the transmission of the signal is contactless.

37. The process according to claim 34, wherein a timer of the lock sensor module is started after a change in the locking state of the lock.

38. The process according to claim 34, wherein the change in the locking state of several locks is successively detected as well as stored and/or displayed.

39. The process according to claim 38, wherein the display is periodically switched between the individual, stored locking states of different locks.

40. The process according to claim 34, wherein after detection of the change in the locking state, a timer on the key is started.

41. The process according to claim 34, wherein the detection of the change in the locking state is linked to the absolute time.

42. The process according to claim 41, wherein the timer and/or the absolute time is displayed.

43. The device for the reliable detection of the locking state of a lock and for transmission to a user claim 34, comprising:

a lock sensor module mounted near the lock for detecting the locking state, a transmitter connected with the lock sensor module for transmitting signals, a logic attachable to the key with a memory with a receiver for receiving and storing the signal received from the lock, a display attachable to the key.

44. The device according to claim 43, wherein the lock sensor module (18) is attached to the striking plate of a doorframe associated with the lock (13).

45. The device according to claim 43, wherein the lock sensor module is coupled with a timer.

46. The device for reliably detecting the change in the locking state of a lock according to claim 34, comprising:

one or several markers mounted near the lock, one or several sensors non-rotatable connected with the key for detecting these markers, a logic attachable to the key with a memory in which data can be stored, whereby the logic can process the signals received from the sensors, and a display for displaying the locking state.

47. The device according to claim 46, wherein one or several sensors for detecting the rotation of the key are provided on the key or on an add-on part.

48. The device according to claim 46, wherein the markers are made as magnets.

49. The device according to claim 46, wherein the sensors are made as Hall sensors and/or reed switches.

50. The device according to claim 46, wherein an additional sensor is provided for detecting the insertion of the key into the lock and/or for detecting the inserted state of the key within the lock.

* * * * *